United States Patent [19]

Senour

[11] 4,438,540

[45] Mar. 27, 1984

[54] WRINGABLE MOP ASSEMBLY

[75] Inventor: Walter H. Senour, Ada, Mich.

[73] Assignee: Amway Corporation, Ada, Mich.

[21] Appl. No.: 323,392

[22] Filed: Nov. 20, 1981

[51] Int. Cl.[3] ..... A47L 13/46

[52] U.S. Cl. ..... 15/119 A

[58] Field of Search ..... 15/244 R, 244 A, 116 A, 15/119 A, 245, 147 R, 146, 147 C, 150, 173, 177

[56] References Cited

U.S. PATENT DOCUMENTS

| | | | |
|---|---|---|---|
| 161,805 | 4/1875 | May . | |
| 1,344,198 | 6/1920 | Beam . | |
| 2,108,727 | 2/1938 | Rogers | 15/119 |
| 2,213,732 | 9/1940 | Goldberg | 15/244 |
| 2,235,264 | 3/1941 | Rogers | 15/119 |
| 2,550,397 | 4/1951 | Bagley, Jr. | 15/119 |
| 2,729,840 | 1/1956 | Rogers | 15/119 A |
| 2,905,960 | 9/1959 | Ward | 15/245 |

*Primary Examiner*—Edward L. Roberts

*Attorney, Agent, or Firm*—Price, Heneveld, Huizenga & Cooper

[57] ABSTRACT

The specification discloses a wringable mop including a sponge pinchingly retained within a channel, a ferrule including an integral mounting plate, a clamp, a roller-carrying bridge, and a wringer handle. A tab extends from the wringer handle through an aperture in the bridge to pivotally connect the wringer handle and the bridge. The clamp is hingedly connected to the mounting plate at two locations, and a bolt passes through the clamp and mounting plate approximately midway between these two locations to draw the clamp and mounting plate together to secure the channel and sponge therebetween. A detent tab extends from the mounting plate into an aperture in the channel to prevent the channel from shifting laterally with respect to the mounting plate.

3 Claims, 6 Drawing Figures

WRINGABLE MOP ASSEMBLY

BACKGROUND OF THE INVENTION

The present invention relates to mops, and more particularly to wringable mops.

The wringable mop has gained widespread popularity due to the fact that it greatly facilitates the task of mopping a floor. These wringable mops typically include a mop handle, a sponge fixedly mounted to the mop handle, and a wringer element movable relative the sponge to wring liquid out of the spronge. Typically, a wringer handle is included, which, when actuated, causes the wringer element to move relative the sponge. Consequently, the entire sponge may be wrung by simply and easily moving a single wringer handle.

Often, a wringable mop includes a ferrule to which a mop handle may be secured, a mounting plate formed integrally with the ferrule, a clamping plate, and means for drawing the clamping and mounting plates together to clamp the sponge assembly therebetween and thereby secure the sponge assembly on the end of the mop handle. The sponge assembly typically includes a sponge retained in a channel, and the channel is the part of the sponge assembly which is clamped between the clamping and mounting plates. However, prior connections between the clamping and abutment plates have not been wholly satisfactory. Because this connection must be extremely rigid when tightened, prior connections are often relatively complex, requiring several bolts and several hinge points to provide the desired rigidity. However, these complex connections are relatively expensive and difficult to assemble. On the other hand, other prior connections are less expensive and less complicated but do not provide the desired structural characteristics.

Second, no provision is typically provided for preventing the sponge from shifting laterally with respect to the mop handle. Consequently, when the mop is in use, the sponge may shift within the mop head so that the sponge is not completely wrung by the wringer. To reduce lateral movement of the sponge, one prior mop includes a clamp surface cut into the upper rear edge of a sponge-retaining channel, which channel is clamped between the clamping and mounting plates. The lower extremity of the mounting plate is positioned against the clamp surface. This does not appear to be a particularly sturdy arrangement, in that the channel would appear to have a tendency to pivot about the extremity of the mounting plate.

A typical wringer element for a wringable mop includes two parallel wringer members disposed on opposite sides of the sponge to compress the sponge when actuated, a bridge interconnecting the wringer members, and a wringer handle pivotally connected to both the ferrule and the bridge which when actuated causes the bridge to operate the wringer members. However, prior mops have required relatively complex, multipiece pivotal connections between the wringer handle and the bridge.

SUMMARY OF THE INVENTION

The aforementioned problems are solved by the three different aspects of the present invention in which a wringable mop is provided having (1) a handle-to-bridge connection which does not require any elements in addition to the handle and the bridge, (2) a double-hinge, single-bolt connection between the clamp and mounting plate, and (3) a flange-and-slot arrangement between either the mounting plate or clamp and the sponge channel to prevent the sponge from shifting laterally with respect to the mop head.

The bridge defines an aperture into which extends a tab from the wringer handle so that the handle is free to pivot, relative the bridge, about the tab within the aperture. This handle-to-bridge connection requires fewer parts, is easier to assemble, and is less expensive than previous handle-to-bridge connections.

The clamp-to-means connection includes means for drawing the clamp and the mounting means together and hinged connections on either side of the drawing means to pivotally connect the clamp to the mounting means. When tightened, the drawing means and the two hinged connections provide a three-point connection between the clamp and the mounting means, providing the desired rigidity while requiring relatively few parts and reducing assembly complexity and cost.

Finally, the sponge-retaining channel defines an aperture in a side wall through which detent means extends from at least one of the clamp and mounting means to prevent the sponge from shifting laterally with respect to the mop head. The clamp and mounting means surfaces clamp firmly against the side walls of the channel, and neither has to function as a detent in and of itself. Consequently, the sponge is both firmly held and positively secured against lateral movement, insuring that the sponge will not shift undesirably during use.

These and other objects, advantages, and features of the invention will be more fully understood and appreciated by reference to the written specification and appended drawings.

DESCRIPTION OF THE PREFERRED EMBODIMENT

Figure 2:
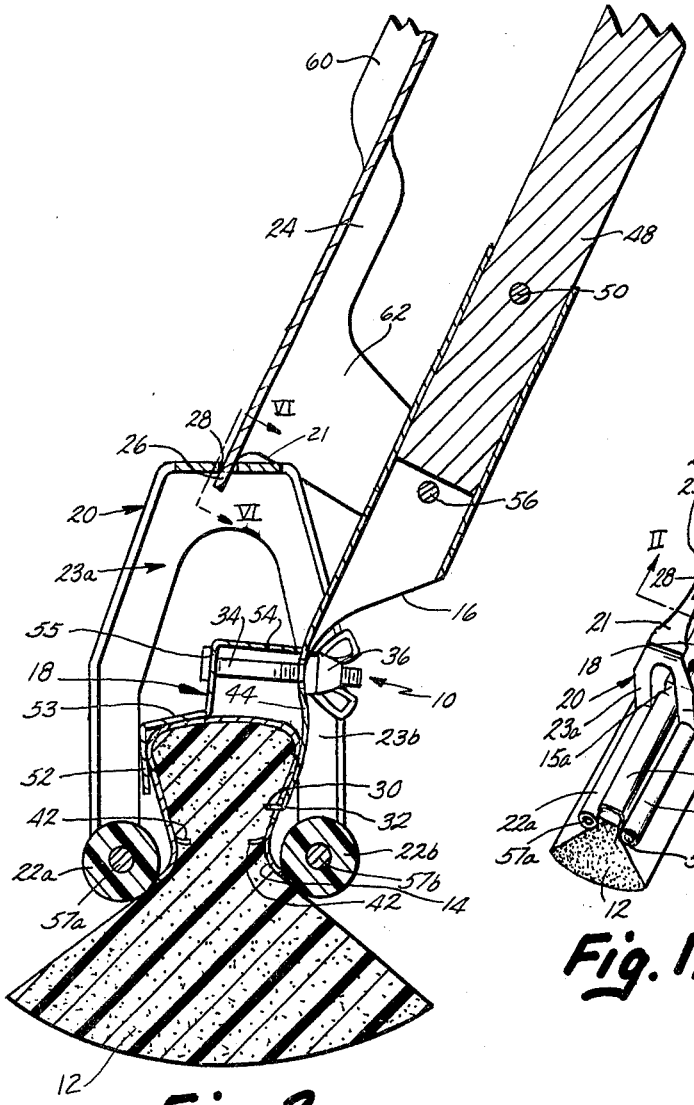
FIG. 2 is a fragmentary, sectional view taken along plane II—II in FIG. 1.

Mop 10 (FIG. 1) constructed in accordance with a preferred embodiment of the invention includes sponge 12, channel 14 within which sponge 12 is pinchingly retained, ferrule 16 for receiving a mop handle 48, and a clamp 18 secured to mounting plate 44 of ferrule 16 to clamp channel 14 therebetween. Bridge 20 carries a pair of parallel rollers **22*a* and 22*b* disposed on opposite sides of sponge 12. Wringer handle 24 is pivotally connected to ferrule 16 and to bridge 20 so that when wringer handle 24 is actuated by pivoting away from mop handle 48, bridge 20 forces rollers 22 downwardly along sponge 12 compressing or wringing sponge 12**.

Figure 3:
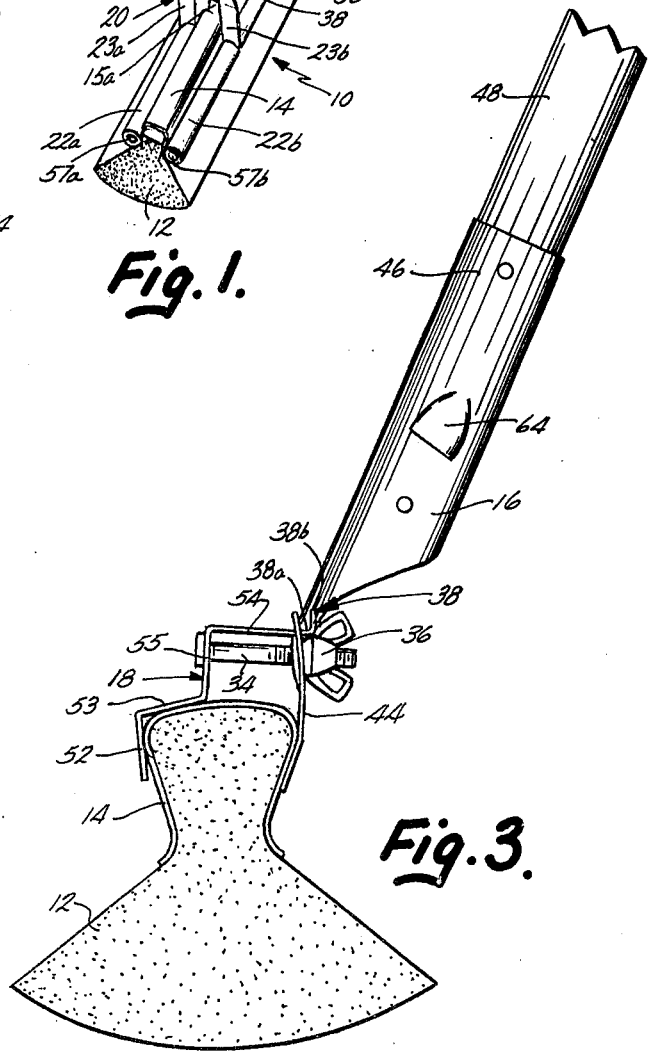
FIG. 3 is a fragmentary, side elevational view of the mop with the bridge and wringer handle removed.
Figure 6:
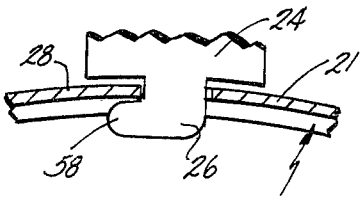
FIG. 6 is a fragmentary, sectional view taken along plane VI—VI in FIG. 2.

Tab 26 (FIGS. 2 and 6) extends from wringer handle 24 through aperture 28 defined in bridge 20. Consequently, handle 24 is free to pivot within bridge 20 about tab 26 without additional interconnecting pieces. Detent tab 30 (FIGS. 2 and 4) extends from mounting plate 44 through an aperture 32 defined in channel 14. Consequently, channel 14 and sponge 12 cannot shift laterally within mop 10 because of the positive engagement of detent tab 30 with channel 14 through aperture 32. Bolt 34 (FIGS. 2, 3, 4, and 5) extends through channel 18 and mounting plate 44 and is secured using nut 36 (FIGS. 2, 3, and 4) to draw the clamp and mounting plate together. Additionally, clamp ears 38 (FIGS. 1, 3, 4, and 5) extend from clamp 18 through apertures 40 (FIG. 4) in mounting plate 44 to hingedly connect the clamp to the mounting plate. In the preferred embodiment, bolt 34 is located approximately midway between ears 38. Accordingly, as claim 18 and mounting plate 44 are drawn together by tightening nut 36 on bolt 34, clamp 18 pivots toward mounting plate 44 about ears 38 (FIG. 3). Bolt 34 and ears 38 together define a three-point connection between the clamp and mounting plate 44 allowing these pieces to be drawn into a rigid connection using a single bolt.

Turning more specifically to the construction of mop 10, sponge 12 (FIGS. 1, 2, 3, 4, and 5) is fabricated of sponge rubber or any other suitable material. Channel 14 is a metal member, generally U-shaped in cross section, extending approximately the full length of sponge 12, and pinchingly engaging the sponge to retain the sponge therein (FIGS. 2 and 3). A plurality of integral barbs 42 (FIGS. 2, 4, and 5) are formed in the opposite side walls of channel 14, by punching or the like. Barbs 42 extend from channel 14 inwardly into sponge 12 to aid in securing the sponge within the channel. Apertures 32 (FIGS. 2 and 4) and 32' (FIGS. 2, 4, and 5) are defined in opposite sides of channel 14 centrally along the length of the channel to selectively receive detent member 30 which projects preferably from mounting plate 44 depending on the orientation of the channel.

Figure 1:
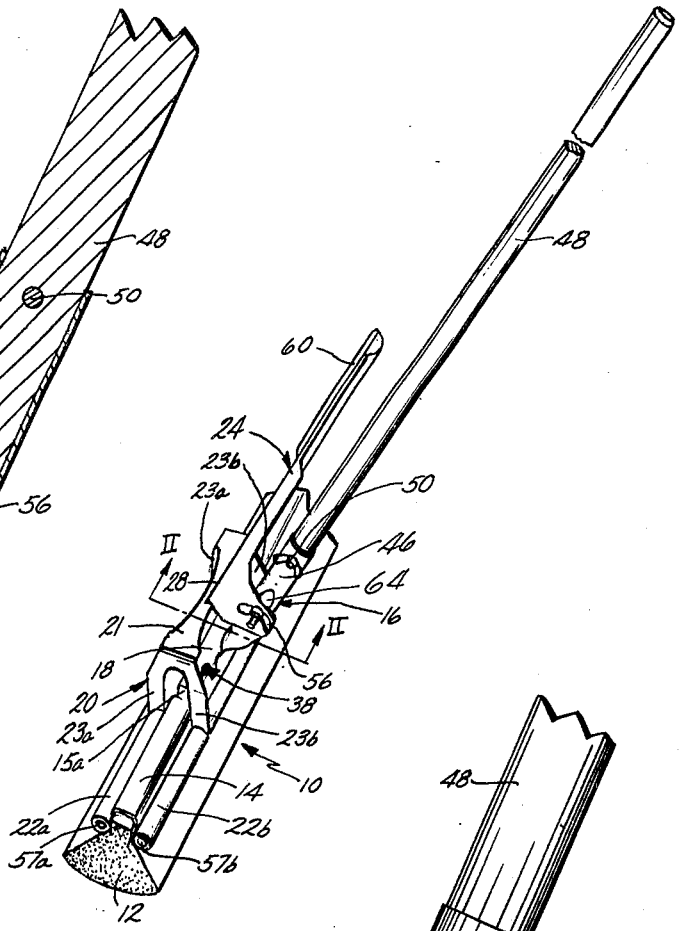
FIG. 1 is a fragmentary, perspective view of a mop constructed in accordance with the present invention.
Figure 5:
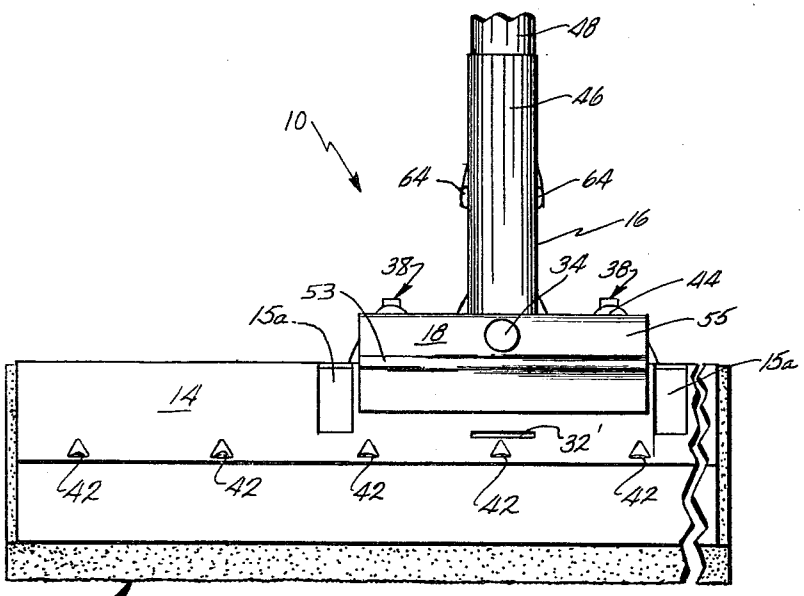
FIG. 5 is a fragmentary, front elevational view of the mop with the bridge and wringer handle removed.

A pair of spaced clearance notches 15*a* are cut in the front side wall of channel 14 and extend a short distance into the top wall thereof (FIGS. 1 and 5). A similar pair of spaced notches 15*b* are located in the rear wall and extend into the top wall of channel 14. Notches 15*a* and 15*b* allow bridge 20 to be lowered without interfering with channel 14.

Figure 4:
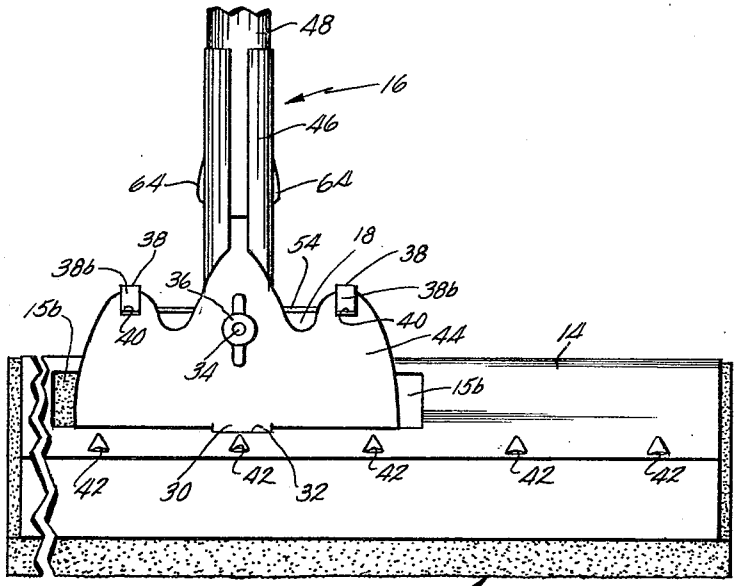
FIG. 4 is a fragmentary, rear elevational view of the mop with the bridge and wringer handle removed.

Ferrule 16 (FIGS. 1, 2, 3, 4, and 5) is a one-piece member and includes a projecting mounting plate 44 joined to a split tubular, handle-receiving portion 46. Thus ferrule 16 is a mounting means for both the mop handle and for the other components of the mop. Mounting plate 44 includes two spaced apertures 40 near the top thereof for receiving ears 38 on clamp 18 (FIG. 4). Integral stops 64 (FIG. 1, 3, 4, and 5) are stamped into receiving portion 46 to engage pivot flanges 62 on wringer handle 24 as will be described. Mop handle 48 extends into receiving portion 46 and is secured therein by bolt 52 which extends through both receiving portion 46 and handle 48.

Clamp 18 (FIGS. 1, 2, 3, 4, and 5) is also a one-piece metal member including a generally vertical forward flange 52, a generally horizontal retainer flange 53, a generally vertical bolt flange 55, and ferrule-abutting flange 54 all sequentially connected. L-shaped ears 38 extend rearwardly and then upwardly at 38*b* from flange 54 through apertures 40 defined in plate 44. Horizontal leg 38*a* (FIG. 3) of each ear extends through aperture 40, and vertical leg 38*b* (FIGS. 3 and 4) of each ear extends upwardly to lock behind mounting plate 44.

Bridge 20 (FIGS. 1 and 2) includes upper plate 21 and two pairs of arms 23*a* and 23*b*, one pair at each end of upper plate 21, extending downwardly therefrom to support axles 55*a* and 55*b*, respectively, on opposite sides of sponge 12. Segmented rollers 22*a* and 22*b* are rotatably mounted on axles 55*a* and 55*b*, respectively, and secured thereon by peening the ends of the axles. Bridge aperture 28 (FIGS. 1, 2, and 3) extends through upper plate 21 to receive the projecting tab 26 extending from wringer handle 24.

Wringer handle 24 (FIGS. 1 and 2) includes a grasping portion 60 at its upper end and a pair of integral pivot flanges 62 positioned on opposite sides of handle-receiving portion 46 of ferrule 16. Bolt 56 extends through both flanges 62 and handle receiving portion 46 to pivotally connect handle 24 to ferrule 16. A projecting tab 26 (FIGS. 2 and 6) is integral with and extends downwardly from wringer handle 24 through aperture 28 in plate 21. Integral projecting tab 26 includes a laterally extending ear 58 (FIG. 6) to lock behind upper plate 21 of bridge 20.

Assembly and Operation

In assembly, clamp ears 38 extend through apertures 40 in mounting plate 44. Bolt 34 extends through bolt flange 55 of clamp 18 and through mounting plate 44. Nut 36 is threaded onto bolt 34. At this point, clamp 18 is very loosely secured to ferrule 16. Next, bridge 20 having rollers 22 installed thereon is positioned about ferrule 16 in approximately the position which it will occupy in the fully assembled mop 10. Handle 24 is installed on bridge 20 by inserting ear 58, followed by the remainder of projecting tab 26, through aperture 28 in plate 21, and then twisting handle 24 into its operative position so that ear 58 locks underneath plate 21. Pivot flanges 62 are aligned with handle receiving portion 46 of ferrule 16 and pivotally secured thereto by passing bolt 56 through both pivot flanges 62 and ferrule 16. Channel 14 having sponge 12 secured therein is then slid longitudinally into position between rollers 22 and also between channel-abutting flange 52 on clamp 18 and mounting plate 44. Detent member 30 is aligned with one of apertures 32 and 32' depending on the orientation of channel 14, and nut 36 is tightened on bolt 34, so that clamp 18 and ferrule 16 are drawn together with member 30 passing into the selected one of apertures 32 and 32'. As clamp 18 is drawn toward ferrule 16, it pivots about ears 38 extending through apertures 40 in mounting plate 44. When fully tightened, channel 14 is rigidly secured between forward flange 52, retainer flange 53, and plate 44. Mop handle 48 is secured to ferrule 16 using bolt 50 to complete assembly.

When one using mop 10 desires to wring sponge 12, he merely grasps portion 60 on handle 24 to pivot the handle about bolt 56. As grasping portion 60 is moved away from mop handle 48, handle 24 exerts downward force on bridge 20 forcing rollers 22 to compress sponge 12 to wring liquid out of the sponge. The upper portions of bridge arms 23*a* and 23*b* pass into clearance notches 15*a* and 15*b*, respectively of channel 14. As handle 24 and bridge 20 are moved relative one another, the handle pivots within the bridge about tab 26 within aperture 28. When grasping portion 60 is released, the expansive force of sponge 12 forces rollers 22 and, consequently, bridge 20 upwardly returning handle 24 to its normal position with pivot flanges 62 engaging integral stops 64 on ferrule 16.

Because apertures 32 and 32' are positioned on opposite sides of channel 14, member 30 will extend into channel 14 regardless of which side of channel 14 faces ferrule 16. This greatly facilitates assembly and permits sponge 12 to be reversed within mop 10 during use.

Mop 10 of the present invention has the desired structural characteristics without the complexity necessary in prior mops to achieve the desired mop function and strength. The flange-and-slot connection between handle 24 and bridge 20 does not require any elements in addition to the handle and the bridge. The single-bolt-and-double-hinge connection of clamp 18 to mounting plate 44 extending from ferrule 16 achieves the necessary structural rigidity while allowing the sponge to be secured in the mop head using a single bolt. Finally, the flange-and-slot structure between mounting plate 44 and channel 14 maintains sponge 12 in fixed lateral relation to ferrule 16.

It should be understood that the above description is intended to be that of a preferred embodiment of the invention. Various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A sponge mop comprising:

a sponge;

a channel pinchingly securing said sponge and including a first aperture;

mounting means adapted to receive a mop handle and defining a pair of second apertures;

a clamp including a pair of ears extending through said pair of second apertures to hingedly connect said clamp to said mounting means;

drawing means for drawing said clamp toward said mounting means to secure said channel between said clamp and said mounting means, whereby said clamp pivots about said ears as said drawing means draws said clamp toward said mounting means;

a detent tab extending from one of said clamp and said mounting means into said first aperture in said channel to prevent said channel from shifting laterally with respect to said mounting means and said clamp;

a bridge movable relative said sponge and carrying a pair of parallel wringer members disposed on opposite sides of said sponge, said bridge defining a third aperture; and a wringer handle pivotally mounted to said mounting means and including a tab extending through said third aperture in said bridge, whereby as said wringer handle is pivoted with respect to said mounting means, said wringer handle pivots with respect to said bridge about said tab forcing said bridge to move relative said sponge to cause said wringer members to wring said sponge.

2. A sponge mop as defined in claim 1 wherein said tab on said wringer handle includes an integral ear locking behind said bridge to secure said wringer handle to said bridge.

3. An improved sponge mop having a channel, a sponge pinchingly secured within said channel, mounting means, a clamp, means for urging said clamp toward said mounting means to secure said channel therebetween, and means for preventing said channel from moving laterally with respect to said mounting means and said clamp, said channel including two opposed side walls, said mounting means and clamp engaging said opposed side walls, wherein the improvement comprises said preventing means comprising:

each of said side walls having an aperture; and detent means extending from at least one of said mounting means and said clamp through one of said side wall apertures to prevent said channel from shifting laterally with respect to said mounting means and said clamp, whereby said channel may be reversed with respect to said mounting means and clamp and still receive said detent means.

* * * * *